US012582878B2

(12) United States Patent
Laszewski

(10) Patent No.: US 12,582,878 B2
(45) Date of Patent: Mar. 24, 2026

(54) SYSTEM AND METHOD FOR ADJUSTING THE ALIGNMENT OF A GOLF CLUB HEAD

(71) Applicant: CSTR8 GOLF, LLC, Amherst, NY (US)

(72) Inventor: Tom Laszewski, Amherst, NY (US)

(73) Assignee: CSTR8 GOLF, LLC, Amherst, NY (US)

( * ) Notice: Subject to any disclaimer, the term of this patent is extended or adjusted under 35 U.S.C. 154(b) by 528 days.

(21) Appl. No.: 18/298,596

(22) Filed: Apr. 11, 2023

(65) Prior Publication Data

US 2023/0241462 A1 Aug. 3, 2023

Related U.S. Application Data

(63) Continuation-in-part of application No. PCT/US2021/054686, filed on Oct. 13, 2021.

(60) Provisional application No. 63/092,867, filed on Oct. 16, 2020.

(51) Int. Cl.
*A63B 53/02* (2015.01)
*A63B 53/00* (2015.01)
*A63B 53/04* (2015.01)

(52) U.S. Cl.
CPC ..... *A63B 53/027* (2020.08); *A63B 53/0441* (2020.08); *A63B 53/007* (2013.01); *A63B 2225/76* (2020.08)

(58) Field of Classification Search
CPC ..... A63B 53/027; A63B 53/0441; A63B 2225/76
USPC ..... 473/314
See application file for complete search history.

(56) References Cited

U.S. PATENT DOCUMENTS 5,116,047 A 5/1992 Phelan et al.
5,435,562 A * 7/1995 Stock ..... A63B 69/3614 473/220
5,465,972 A * 11/1995 Cornett ..... A63B 69/3614 473/409
5,692,965 A * 12/1997 Nighan, Jr. ..... A63B 69/3614 362/249.11
5,759,110 A * 6/1998 Seibel ..... A63B 69/3614 473/220
5,882,266 A * 3/1999 Schaum ..... A63B 69/3614 473/240

(Continued)

OTHER PUBLICATIONS

Rodriquez, Kari, "International Search Report and Written Opinion of the International Searching Authority", PCT International Application No. PCT/US2021/054686 filed on Oct. 13, 2021, mailed on Jan. 19, 2022, United States Patent and Trademark Office, Alexandria, VA (11 pages).

(Continued)

*Primary Examiner* — Allyson N Trail
(74) *Attorney, Agent, or Firm* — Woods Oviatt Gilman LLP; Dennis B. Danella, Esq.

(57) ABSTRACT

A system for adjusting alignment of a golf club head includes a club shaft having a proximal end and an opposing distal end, with a hosel fitting fixedly secured to the distal end of the club shaft. A neck is rotationally coupled to the hosel fitting at a first end and a club head is coupled to the second end of the neck. The hosel fitting includes a reference line and the neck includes a series of angle index lines. The angle of the club face is adjusted by selectively aligning a singled angle index line with the reference line.

17 Claims, 16 Drawing Sheets

(56) References Cited

U.S. PATENT DOCUMENTS

| | | | | |
|---|---|---|---|---|
| 5,919,098 | A * | 7/1999 | Salmon | A63B 69/3614 362/184 |
| 6,398,663 | B1 * | 6/2002 | Lin | A63B 69/3632 473/224 |
| 6,758,760 | B1 * | 7/2004 | Kellogg | A63B 69/3632 473/220 |
| 7,867,110 | B2 | 1/2011 | Edel | |
| 7,927,226 | B1 | 4/2011 | Twitty | |
| 8,668,597 | B2 | 3/2014 | Yamamoto | |
| 8,827,827 | B2 | 9/2014 | Yamamoto | |
| 9,630,067 | B2 | 4/2017 | Kohno et al. | |
| 10,220,267 | B2 | 3/2019 | Holtzman | |
| 10,346,559 | B2 | 7/2019 | Sander et al. | |
| 2001/0041622 | A1 * | 11/2001 | Taylor | A63B 69/3614 473/201 |
| 2001/0041623 | A1 * | 11/2001 | Rosselli | A63B 69/3608 473/207 |
| 2002/0010033 | A1 | 1/2002 | Aoki et al. | |
| 2005/0202894 | A1 * | 9/2005 | Finney | A63B 69/3685 473/220 |
| 2005/0261072 | A1 | 11/2005 | Adams | |
| 2006/0040758 | A1 * | 2/2006 | Coates | A63B 69/3614 473/258 |
| 2006/0122001 | A1 * | 6/2006 | Gaddy | A63B 69/3667 473/220 |
| 2006/0258473 | A1 * | 11/2006 | Khananayev | A63B 69/3676 473/220 |
| 2007/0167248 | A1 | 7/2007 | Fler et al. | |
| 2012/0077609 | A1 | 3/2012 | Tonkin | |
| 2013/0324286 | A1 | 12/2013 | Sander et al. | |
| 2017/0014688 | A1 * | 1/2017 | Dolezel | B23K 26/361 |
| 2017/0326427 | A1 * | 11/2017 | Smith | G09B 19/0038 |
| 2018/0264328 | A1 | 9/2018 | Moore | |
| 2023/0085822 | A1 * | 3/2023 | Parsons | A63B 53/0487 29/592 |
| 2023/0241462 | A1 * | 8/2023 | Laszewski | A63B 53/0441 473/314 |
| 2025/0303241 | A1 * | 10/2025 | Sanyal | A63B 69/3614 |

OTHER PUBLICATIONS

"Mainstreethost—Cstr8 Golf Animated Slideshow" (Mainstreethost) Apr. 9, 2014 (Apr. 9, 2014) [online] retrieved from <URL: https://www.youtube.com/watch?v=jzwP_g-e98k>, entire document, especially annotated drawing and min 0:31-0:47.

"CSTR8GOLF Raised Optic" (CSTR8 Golf) May 17, 2017 (May 17, 2017) [online] retrieved from <URL: https://www.youtube.com/watch?v=qi6-CZADRL4>, entire document, especially annotated drawing.

"CSTR8GOLF Introduction" (CSTR8 Golf) May 16, 2017 (May 16, 2017) [online] retrieved from <URL: https://www.youtube.com/watch?v=e3vv53a1N148a-41s>, entire document, especially min 0:36-0:43, 0:47-1:19.

* cited by examiner

SYSTEM AND METHOD FOR ADJUSTING THE ALIGNMENT OF A GOLF CLUB HEAD

CROSS-REFERENCE TO RELATED APPLICATIONS

This application is a continuation-in-part application of PCT Application No. PCT/US2021/054686 filed on Oct. 13, 2021, which in turn claims the benefit of U.S. Patent Application No. 63/092,867, filed Oct. 16, 2020, the contents of each are hereby incorporated by reference in their entirety.

FIELD OF THE INVENTION

The present invention relates to a system and method for aligning a golf club head relative to the club shaft, and more particularly to a system and method employing a laser alignment aid to compensate and correct for a golfer's natural visual deviation from a perceived straight line, and still more particularly to a system and method for adjusting the angle of the forward horizontal plane of a club face about a center vertical axis of the club head.

BACKGROUND OF THE INVENTION

In the game of golf, every stroke matters. A single stroke may determine whether a golfer makes the cut or whether the golfer wins the tournament or finishes off the leaderboard. Golf is also a game of inches, particularly when on the putting green where fractions of an inch make the difference between finishing a hole or adding one, two or even more strokes to the round. As a result, golfers are always looking for ways to eliminate strokes from their game.

One critical aspect of achieving golf success is consistently properly addressing the ball prior to each stroke. That is, a golfer must position his or her body, and the club head of the golf club, in the proper alignment such that the golf ball travels as intended after being struck by the dub head. Any misalignment will result in an errant strike causing the ball to travel off the intended line, thereby resulting in extra strokes being required to finish the hole.

Thus, there is a need for a system and method that corrects for a golfer's natural visual deviation from a perceived straight line by adjusting the angle of a club face about a center vertical axis of the club head. The present invention addresses these, and other, needs.

BRIEF SUMMARY OF THE INVENTION

It is, therefore, an aspect of the present invention to provide a system for adjusting alignment of a golf club head. The system comprises: a club shaft having a proximal end and an opposing distal end; a hosel fitting fixedly secured to the distal end of the club shaft; a neck having a first end and a second end, wherein the first end is rotationally coupled to the hosel fitting; and a club head coupled to the second end of the neck, wherein the club head defines a club face. In one aspect, rotation of the neck about the hosel fitting adjusts an angle of the club face relative to a vertical axis defined by the club shaft. As such, the hosel fitting includes one of a reference line or a series of angle index lines, and wherein the neck includes the other of the reference line or the series of angle index lines, whereby the angle is selectively adjusted by selectively aligning a single angle index line with the reference line. Each successive angle index line within the series of angle index lines may correspond to 1 degree of rotation of the club face. Once in the desired position, the neck is secured to the hosel fitting through an interference fit to thereby prevent further rotation of the neck.

In a further aspect of the present invention, the club head includes a raised sight line extending upwardly of a plane formed by a top edge of the club face, wherein the raised sight line is perpendicular to the club face. A forward end of the raised sight line terminates a spaced distance from the club face and may extend perpendicularly from the midpoint of the tope edge of the club face.

In still another aspect of the present invention, the proximal end of the club shaft includes a grip having a circular cross section. The grip has a tapered length wherein a first portion of the grip proximate the proximal end of the club shaft has a smaller diameter than a second portion of the grip distal the proximal end of the club shaft.

In a further aspect of the present invention, the club head comprises a fitting head having a body portion defining a club face and a tubular portion extending perpendicularly rearward from the club face, wherein the club face includes an aperture in communication with an open interior of the tubular portion, and wherein the open interior is dimensioned to receive a laser unit therein, wherein powering of the laser causes a light beam to extend outwardly of the club face through the aperture. The body portion includes a pair of neck receiving apertures, wherein a first aperture of the pair of apertures is configured to receive the neck portion to create a right-handed golf club and wherein a second aperture of the pair of apertures is configured to receive the neck portion to create a left-handed golf club. One or both of the body portion and the tubular portion include a threaded aperture portion to threadably couple the laser unit to the fitting head and powering of the laser is via remote control.

In still another aspect of the present invention a golf club head includes a body portion defining a club face and a tubular portion defining an open interior extending perpendicularly rearward from the club face. The open interior is dimensioned to receive a laser unit therein. An aperture is defined within the club face and is in communication with the open interior of the tubular portion. A battery compartment is defined within the body portion and extends perpendicularly to the tubular portion. The battery compartment is configured to receive a battery therein. The battery is configured to be electrically connected to the laser wherein powering of the laser unit via the battery causes a light beam to extend outwardly of the club face through the aperture. In a further aspect, the body portion may further define at least one lateral adjustment aperture adapted to threadably receive a corresponding set screw therein. Alignment of the laser unit is adjustable via the set screw.

In yet another aspect of the present invention, a method for adjusting the alignment of a golf club head, the method comprises: a) providing a golf club having a fitting head mounted thereon, the fitting head comprising: i) a club shaft having a proximal end and an opposing distal end; ii) a hosel fitting fixedly secured to the distal end of the club shaft; iii) a neck having a first end and a second end, wherein the first end is rotationally coupled to the hosel fitting; and iv) a club head coupled to the second end of the neck, wherein the club head has body portion and a tubular portion extending perpendicularly rearward therefrom, wherein the body portion defines a club face, and wherein the club face includes an aperture in communication with an open interior of the tubular portion, and wherein the open interior is dimensioned to receive a laser unit therein, wherein powering of the laser causes a light beam to extend outwardly of the club face through the aperture, b) positioning a golfer a predetermined distance away from a stationary target; c) allowing the golfer to align the golf club to the stationary target to establish a golfer alignment value; d) powering the laser to emit a laser beam from the golf club toward the stationary target; e) determining an amount of deviation of the golfer alignment value from a true alignment value; f) rotating the neck on the hosel fitting to negate the amount of deviation; and g) securing the neck to the hosel fitting to prevent further rotation of the neck. The method may further include h) removing the fitting head from the neck after securing the neck to the hosel filling (step g); and i) securing a desired club head to the neck.

Additional aspects, advantages and novel features of the present invention will be set forth in part in the description which follows, and will in part become apparent to those in the practice of the invention, when considered with the attached figures.

BRIEF DESCRIPTION OF THE DRAWINGS

The accompanying drawings form a part of this specification and are to be read in conjunction therewith, wherein like reference numerals are employed to indicate like parts in the various views, and wherein.

DETAILED DESCRIPTION OF THE INVENTION

Figure 1:
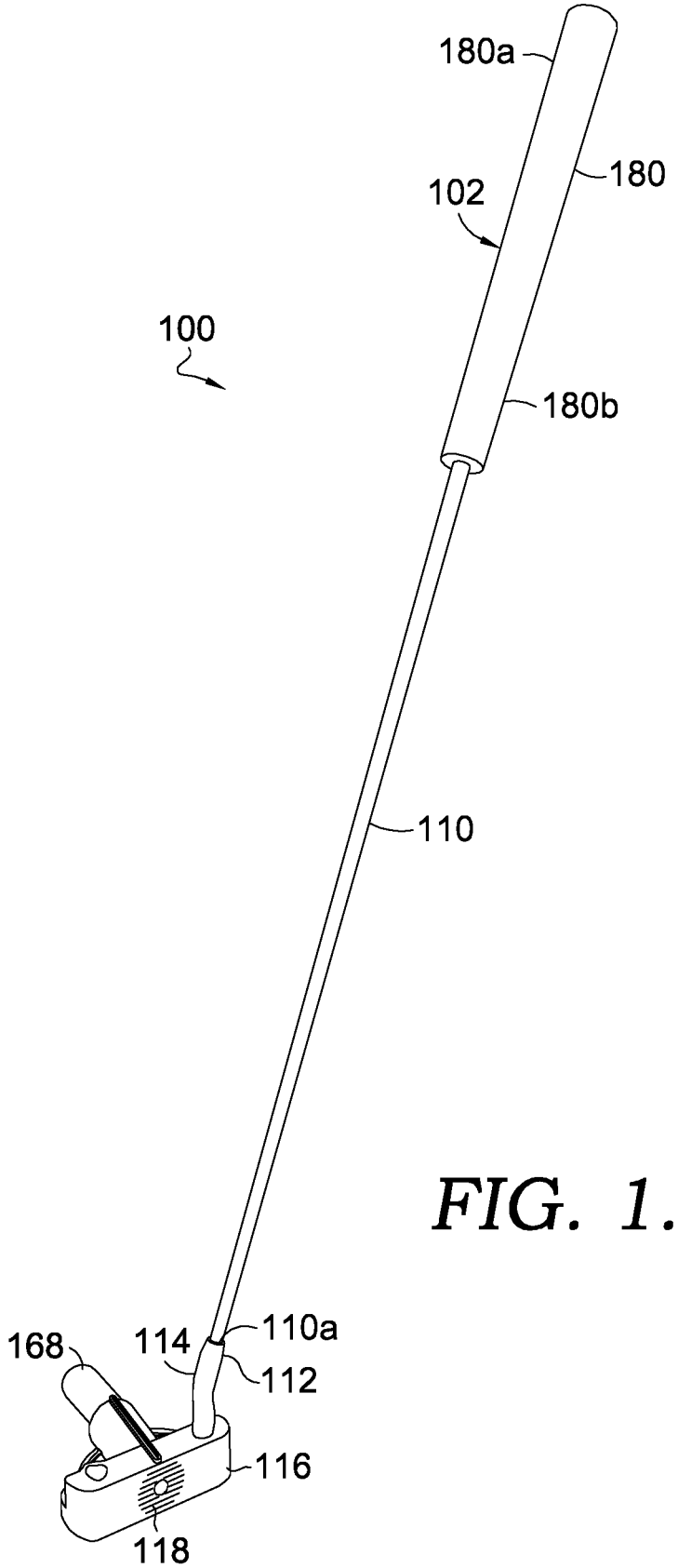
FIG. 1 is an exemplary embodiment of a system for adjusting alignment of a golf club head in accordance with an aspect of the present invention.
Figure 1A:
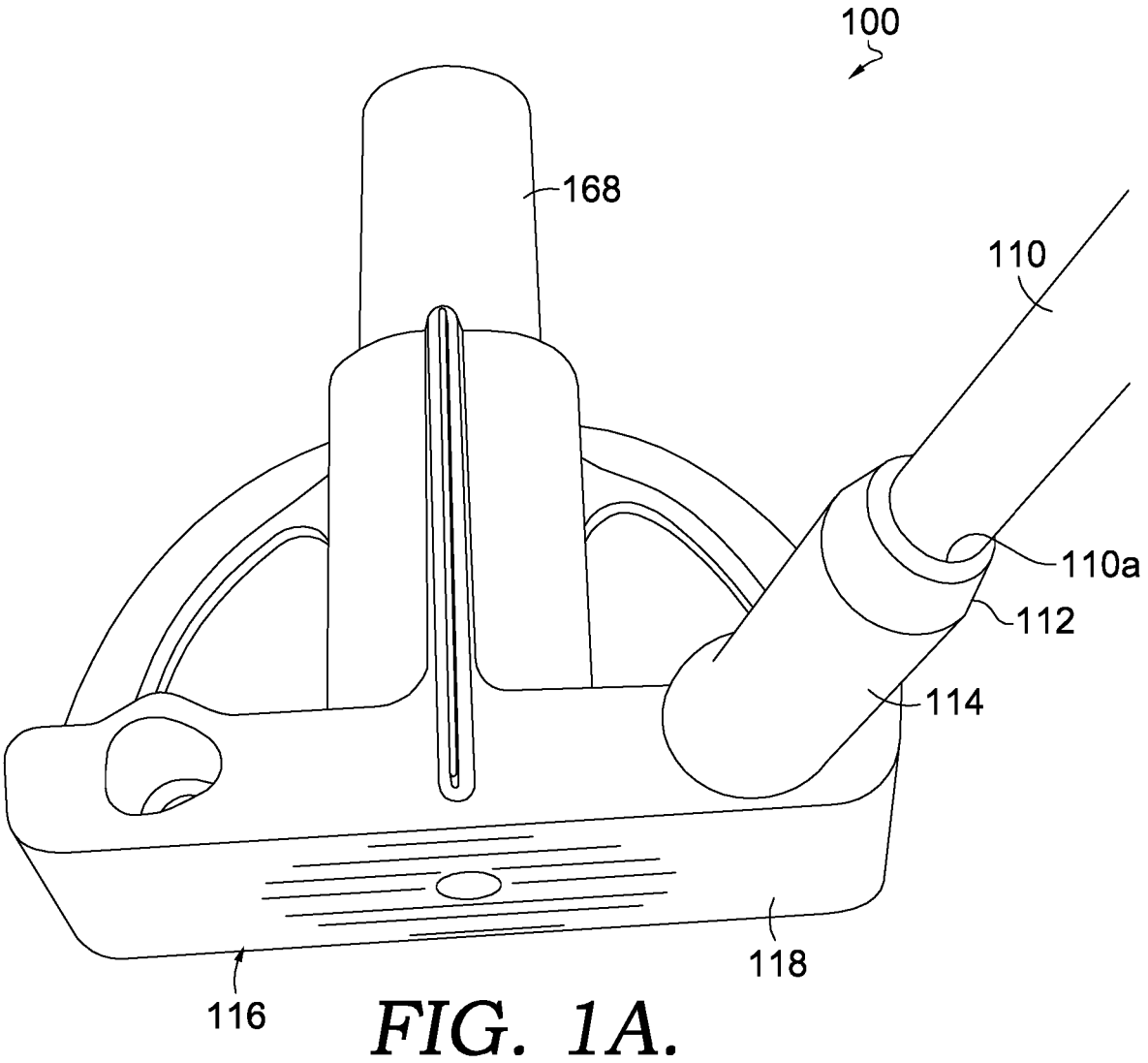
FIG. 1A is an expanded view of an embodiment of a fitting head used within the exemplary system shown in FIG. 1.

With reference to FIGS. 1 and 1A, a system for adjusting the alignment of a golf club head is generally indicated by reference numeral 100. System 100 includes a golf club 102 formed by a club shaft 110, hosel fitting 112, neck 114 and club head 116. In accordance with an aspect of the invention, hosel fitting 112 may be fixedly secured to distal end 110*a* of club shaft 110 while neck 114 is rotationally coupled to hosel fitting 112. Club head 116 may then be coupled to the opposing end of neck 114. In this manner, club face 118 of club head 116 may be rotationally adjusted relative to the longitudinal axis of club shaft 110 as will be discussed in greater detail below.

Figure 2A:
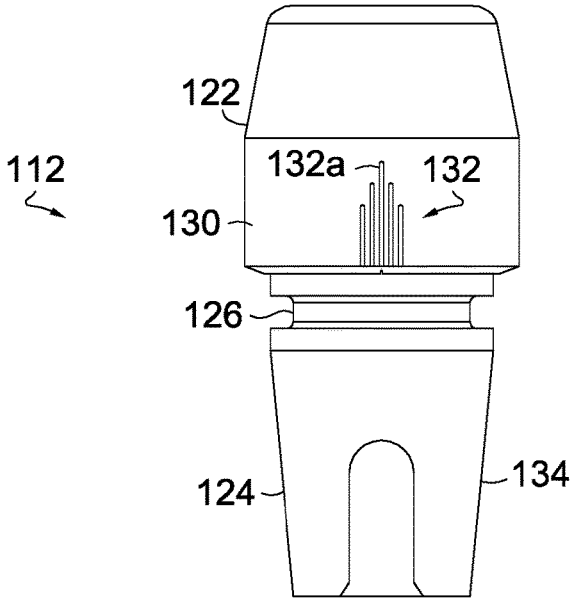
FIGS. 2A-2C show an embodiment of a hosel fitting used within the exemplary system shown in FIG. 1.
Figure 2B:
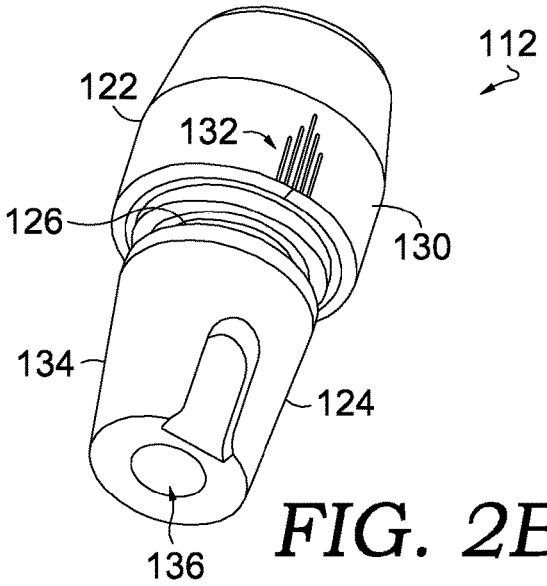
Figure 2C:
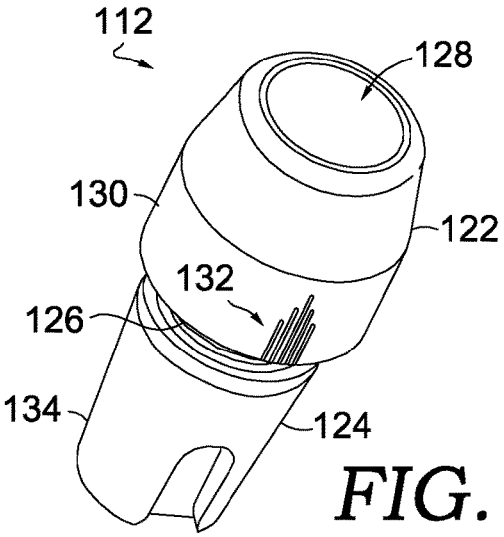

Turning now to FIGS. 2A-2C, hosel fitting 112 has a generally cylindrical hosel body 120 having a shaft end 122 and a neck end 124 segregated by a groove 126. Groove 126 is dimensioned to receive an O-ring seal (not shown) therein. Shaft end 122 defines a shaft bore 128 for receiving club shaft 110 therein. Club shaft 110 is fixedly secured within shaft bore 128 using any suitable technique, such as but not limited to a weld, epoxy or interference fit. Face 130 of shaft end 122 may also include a series of index lines 132 which will be described in greater detail below. Neck end 124 may include a tapered sidewall 134 dimensioned to be received within neck 114 and includes a neck bore 136 dimensioned to receive a neck fastener therein. In one non-limiting example, neck bore 136 may define female threads adapted to engage corresponding male threads of a bolt (not shown) so as to secure neck 114 to hosel fitting 112.

Figure 3A:
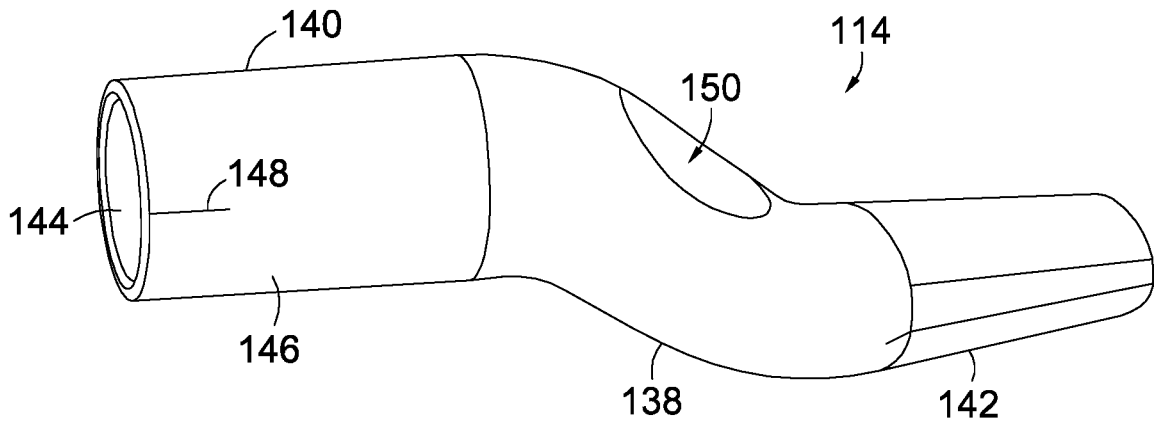
FIGS. 3A and 3B shown an embodiment of a neck used within the exemplary system shown in FIG. 1.
Figure 3B:
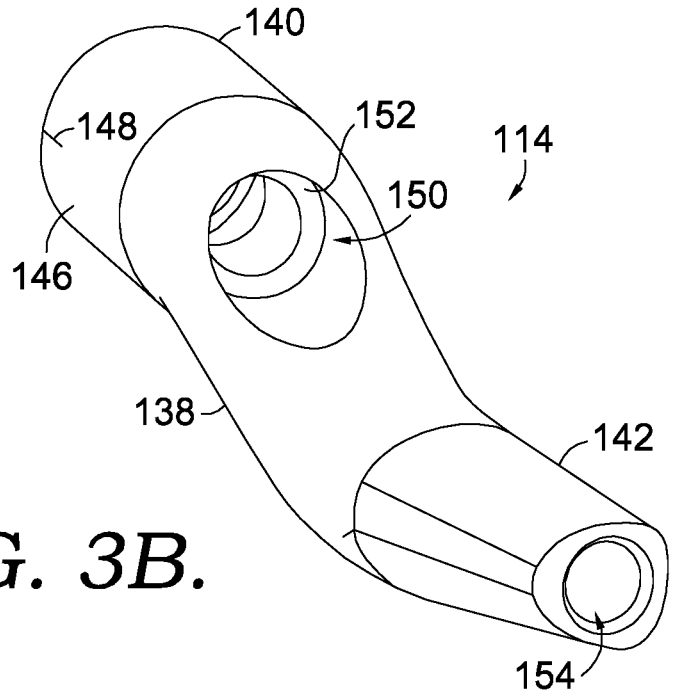

With reference to FIGS. 3A and 3B, neck 114 may be configured as an offset body 138 wherein hosel end 140 has a different longitudinal axis than club end 142. Hosel end 140 may also be non-parallel to club end 142. Hosel end 140 defines a hosel aperture 144 dimensioned to snuggly receive neck end 124 of hosel fitting 112 therein via an interference fit.

Outer face 146 of hosel end 140 may include a reference line 148 scribed thereon, such as through laser etching.

When neck 114 is mounted onto hosel fitting 112, reference line 148 is aligned with one of the index lines within series 132 (e.g., index line 132*a*, FIG. 2A). The interaction of reference line 148 and index lines 132 will be discussed in greater detail below. Offset body 138 may include a hosel connecting bore 150 in communication with hosel aperture 144. Hosel connecting bore 150 includes a shoulder 152 configured to abut the head of a fastener, such as a bolt, when the bolt is inserted through hosel connecting bore 150 and threadably engage the female threads defined within neck bore 136 of hosel fitting 112.

Opposing club end 142 is adapted to be received within a corresponding aperture defined within a club head 116 (discussed below). In one aspect of the invention, club end 142 (and the club head aperture) has a non-circular cross-section such that club end 142, and therefore neck 114, may be coupled to club head 116 via an interference fit in only one orientation. Club end 142 may also define a head fastener bore 154 adapted to threadably receive a fastener, such as bolt, so as to releasably couple club head 116 to neck 114 to form a completed golf club 102 (FIG. 1).

FIGS. 4-9 show an exemplary club fitting head 116*b* adapted for use within system 100. By way of example and without limitation thereto, fitting head 116*b* is shown as a blade style putter head. Fitting head 116*b* includes a body portion 160 and a tubular portion 162 extending perpendicularly rearward from body portion 160. Body portion 160 defines club face 118*b*. Club face 118*b* defines an aperture 164 therethrough which is in communication with open interior 166 defined by the wall of tubular portion 162 (see FIG. 9). Open interior 166 is dimensioned to receive a laser unit 168 therein (see FIGS. 1 and 1A). As will be discussed in greater detail below, powering of laser unit 168 cause a light beam 170 (FIGS. 14 and 15) to extend outwardly though aperture 164. In accordance with an aspect of the present invention, laser unit 168 may be a remote control activated laser unit such that the laser may be powered without requiring user contact with the unit.

Figure 6:
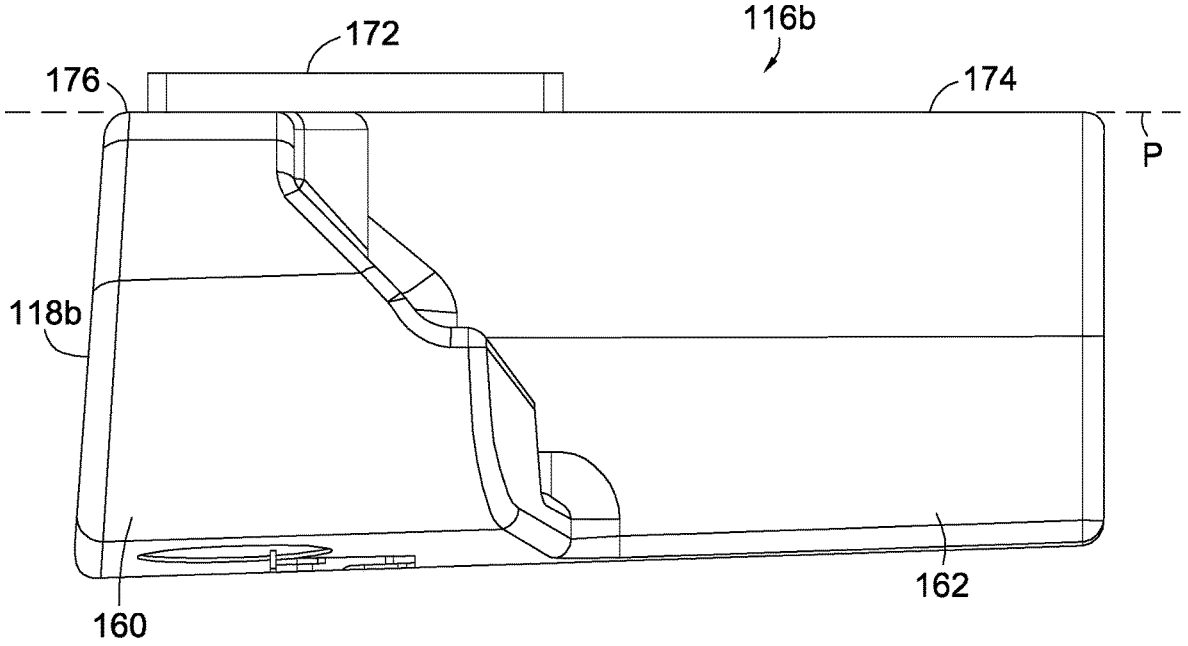
FIG. 6 is a side view of the blade style fitting head shown in FIG. 4.
Figure 7:
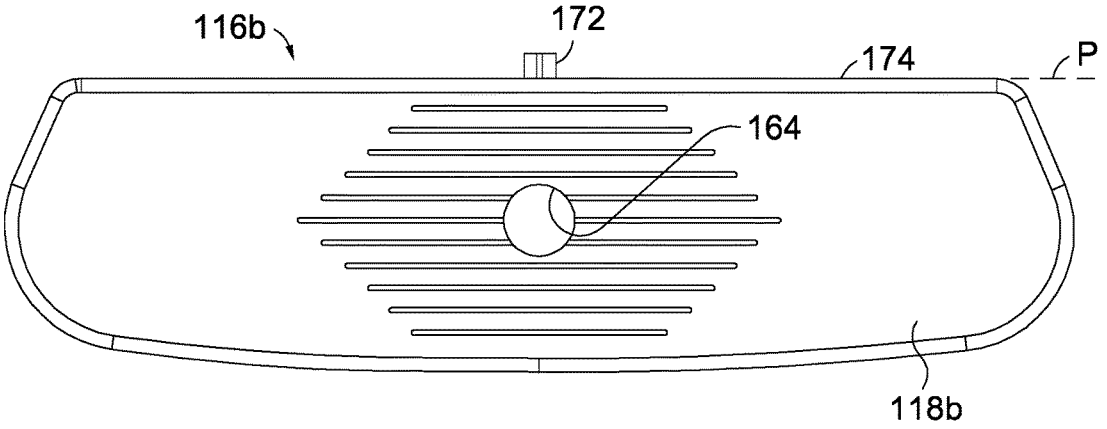
FIG. 7 is a front view the blade style fitting head shown in FIG. 4.
Figure 9:
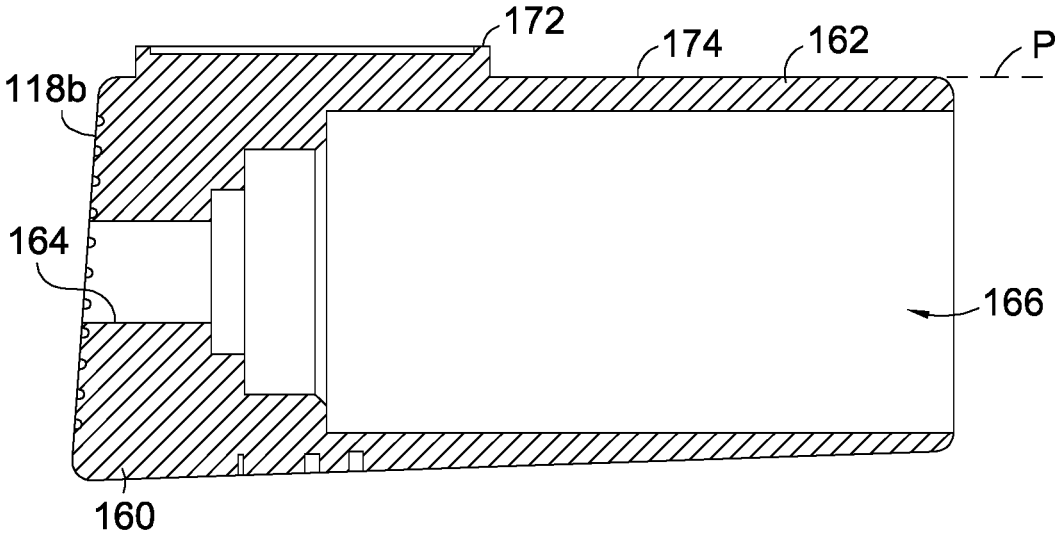
FIG. 9 is a cross section view the blade style fitting head shown in FIG. 4, taken generally along line 9-9 in FIG. 8.
Figure 10A:
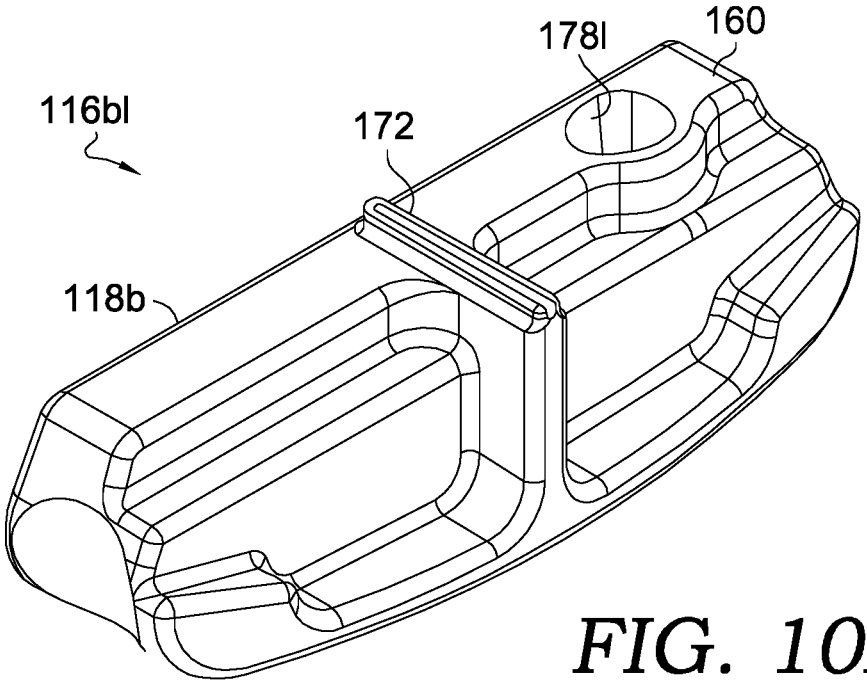
FIG. 10A is a rear perspective view of a final blade style club head configured for left-handed users.
Figure 10B:
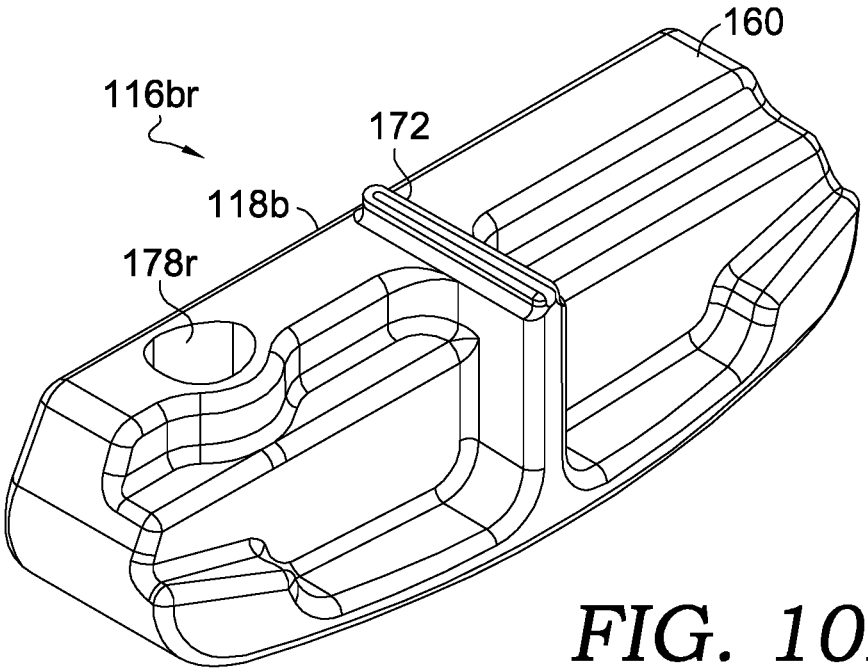
FIG. 10B is a rear perspective view of a final blade style club head configured for right-handed users.

Fitting head 116*b* may further include a raised sight line 172 extending upwardly of the plane P formed by the top edge 174 of fitting head 116*b* (see FIGS. 6 and 9). Raised sight line 172 is perpendicular to club face 118*b* and is placed midway along club face 118*b*. In accordance with an aspect of the invention, the forward edge 172*a* of raised sight line 172 is a spaced distance 176 from club face 118*b*. Spaced distance 176 provides a visual break between raised sight line 172 and a golf ball which may assist the golfer is aligning the club head with the chosen target (for instance, a golf hole or cup). Raised sight line 172 may extend rearward any desired length, such as and without limitation thereto, the width of body portion 160; the width of body portion 160 and an intermediate length of tubular portion 162 (FIG. 4); or the entire width of body portion 160 and tubular portion 162 (FIGS. 10A and 10B).

In accordance with another aspect of the invention, the raised sight line 172 may be a color selected to contrast with the surface the club head 116. By way of example and without limitation thereto, club head 116 may comprise a black anodized aluminum construction. Raised sight line 172 may then be any color other than black, and in one aspect of the invention is selected to be orange. It has been found that the color orange provides sufficient contrast (as opposed to cooler colors such as blue, green or yellow) while also not being visually jarring, such as when using hot colors, such as red. Raised sight line 172 may be added to club head 116 by any suitable means, such as by painting or through affixing a filament element.

Figure 4:
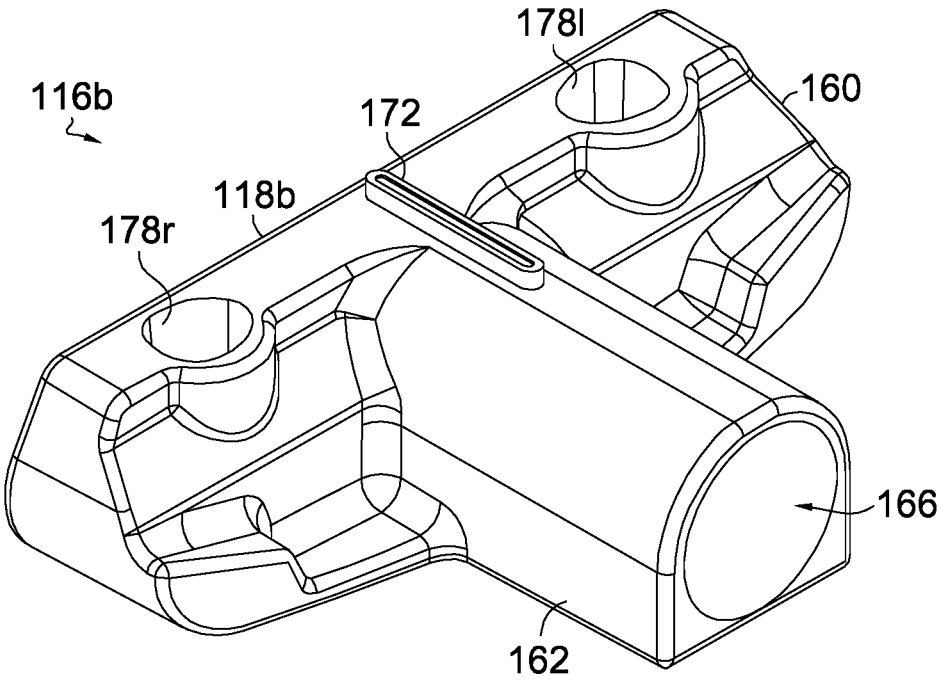
FIG. 4 is a top rear perspective view of an embodiment of a blade style fitting head for use within a system for adjusting alignment of a golf club head in accordance with an aspect of the present invention.
Figure 5:
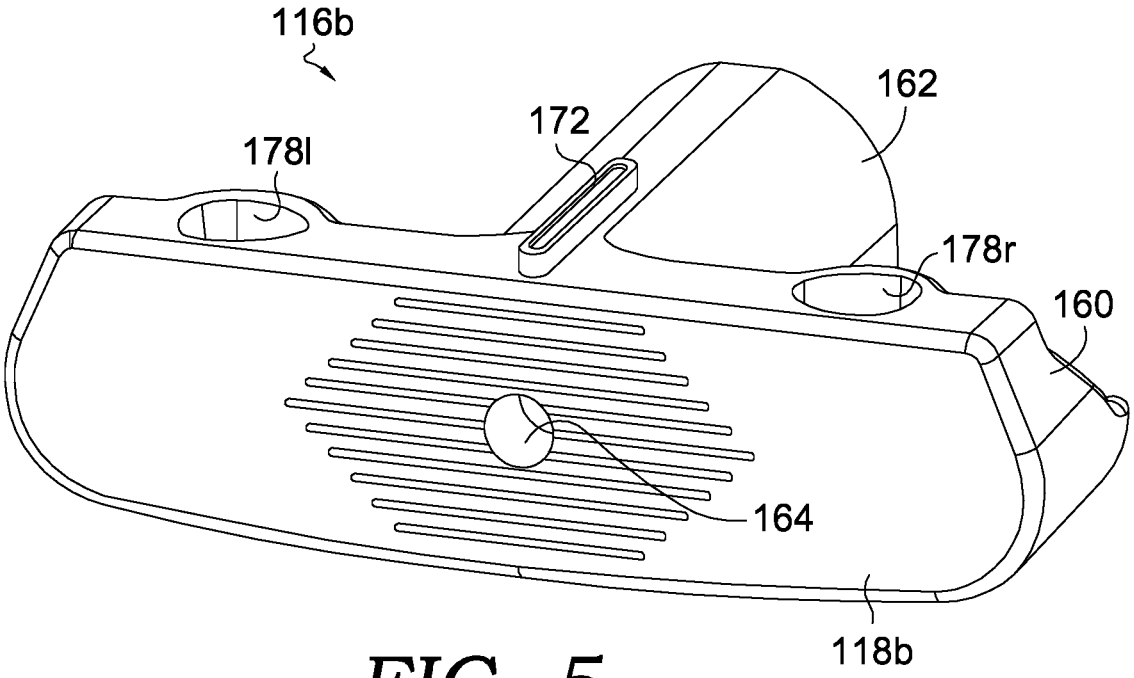
FIG. 5 is a top front perspective view of the blade style fitting head shown in FIG. 4.
Figure 8:
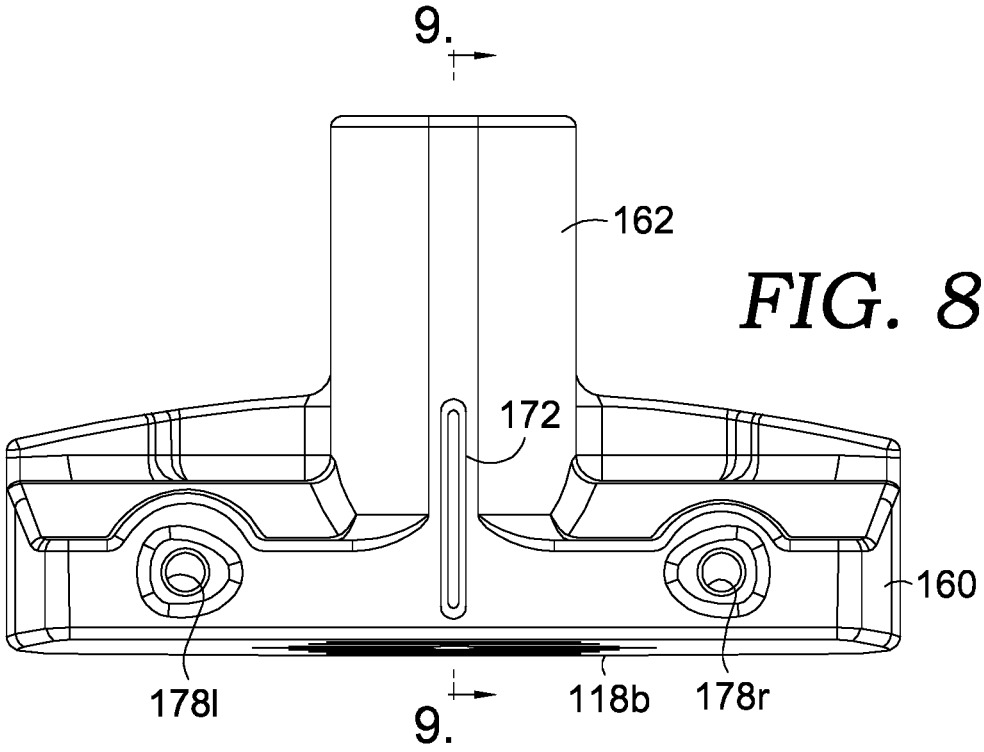
FIG. 8 is a top view the blade style fitting head shown in FIG. 4.

With reference to FIGS. 4, 5 and 8, fitting head 116*b* may include a pair of neck receiving orifices 1781 and 178*r*. Neck receiving orifice 1781 is dimensioned to snuggly receive club end 142 of neck 114 such that fitting head 116*b*, neck 114, hosel fitting 112 and club shaft 110 create a left-handed oriented golf club. Conversely, neck receiving orifice 178*r* is dimensioned to snuggly receive club end 142 of neck 114 such that fitting head 116*b*, neck 114, hosel fitting 112 and club shaft 110 create a right-handed oriented golf club. Thus, fitting head 116*b* may be adapted to suit either a left-handed or right-handed golfer.

Following fitting of the club head (as will be discussed below), fitting head 116*b* may be removed from neck 114. A final golf head may then be secured to neck 114. By way of example, a left-handed club head 116*bl* may omit right neck receiving orifice 178*r* (FIG. 10A) while a right-handed club head 116*br* may omit left neck receiving orifice 1781 (FIG. 10B). As also shown in FIGS. 10A and 10B, final golf heads 116*bl* and 116*br* may omit tubular portion 162 and the final golf heads do not need to mount a laser unit to the head.

Figure 11:
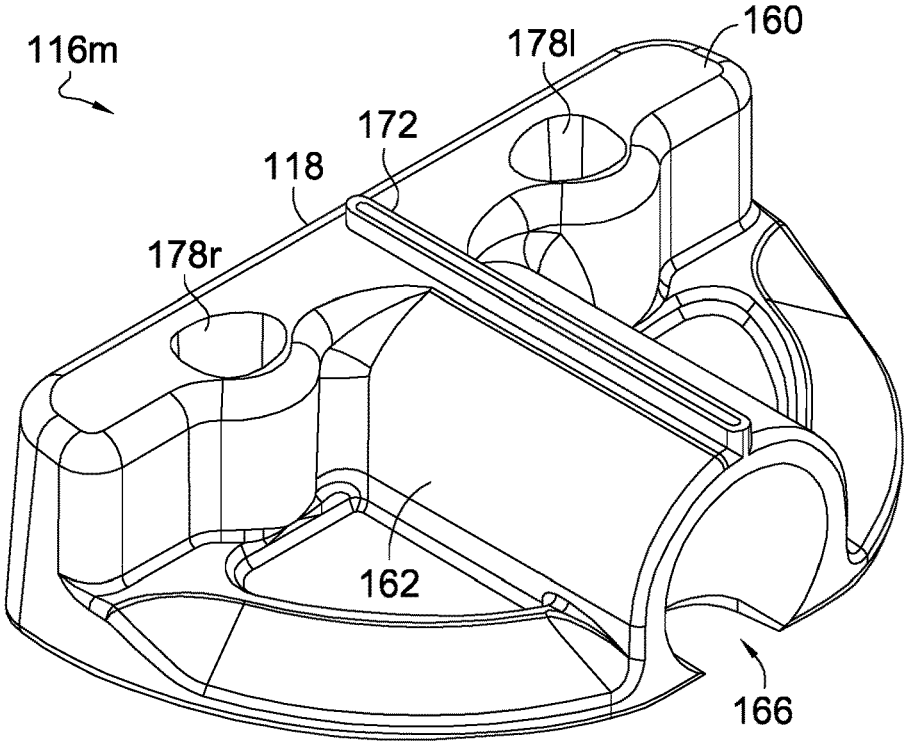
FIG. 11 is a top rear perspective view of an embodiment of a mallet style fitting head for use within a system for adjusting alignment of a golf club head in accordance with an aspect of the present invention.
Figure 12:
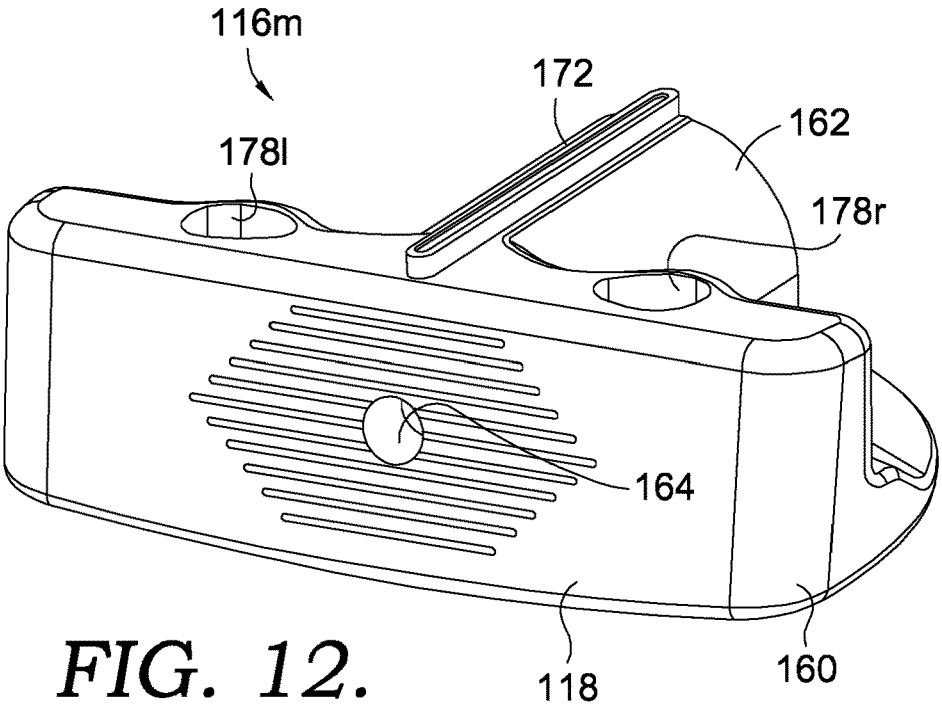
FIG. 12 is a top front perspective view of the mallet style fitting head shown in FIG. 11.
Figure 13A:
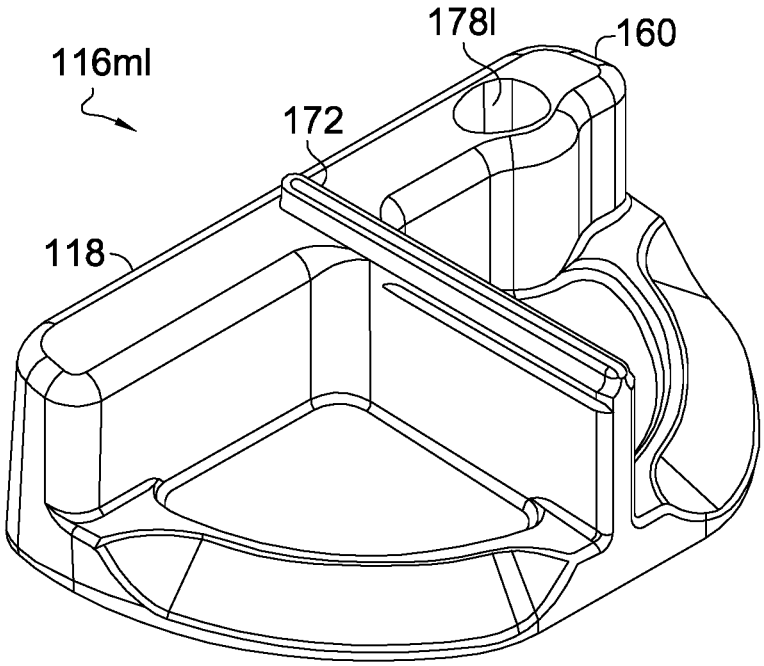
FIG. 13A is a rear perspective view of a final mallet style club head configured for left-handed users.
Figure 13B:
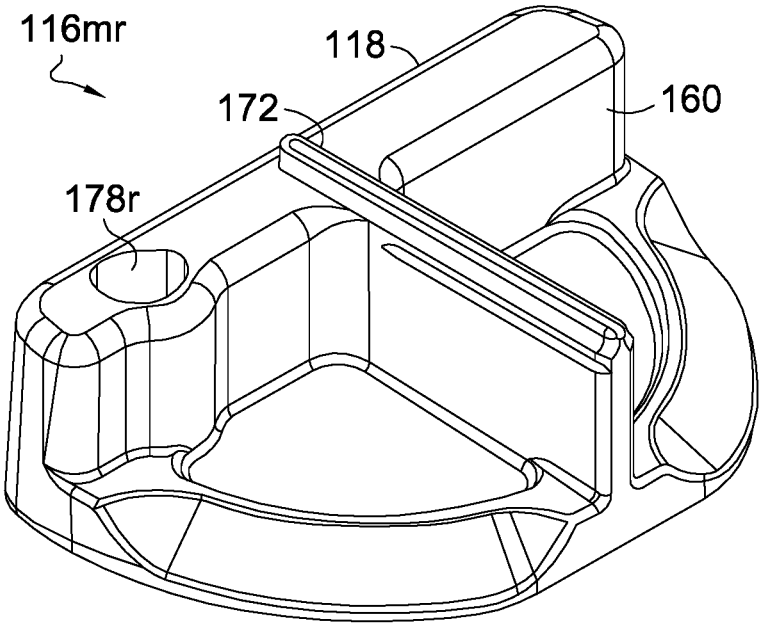
FIG. 13B is a rear perspective view of a final mallet style club head configured for right-handed users.

FIGS. 11 and 12 show an alternative embodiment of a fitting head 116*m* in the style of a mallet style putter head. Apart from the differences in shape, fitting head 116*m* is otherwise functionally the same as fitting head 116*b*, including having a body portion 160', tubular portion 162', raised sight line 172' and neck receiving orifices 1781' and 178*r*'. Similarly, FIGS. 13A and 13B shown left (13A) and right (13B) final golf heads in the mallet style, 116*ml* and 116*mr*, respectively. As neck receiving orifices 1781, 178*r*, 178*l*' and 178*r*' are identical, each respective orifice may independently receive club end 142 of neck 114. As such, a golfer may readily interchange a blade style final head (FIGS. 10A and 10B) with a mallet style final head (FIGS. 13A and 13B) and vice versa.

FIGS. 16-25 show another alternative embodiment of an exemplary club fitting head 216 adapted for use within system 100. By way of example and without limitation thereto, fitting head 216 is shown as a blade style putter head. Fitting head 216 includes a body portion 260 having a tubular portion 262 extending perpendicularly rearward from club face 218 defined by body portion 260. Club face 218 defines an aperture 264 therethrough which is in communication with open interior 266 defined by the wall of tubular portion 262 (see FIGS. 16, 18, 19 and 22). Open interior 266 is dimensioned to receive a laser unit (not shown) and/or an optional laser sleeve 268 adapted to receive the laser unit therein (see FIG. 16).

Figure 22:
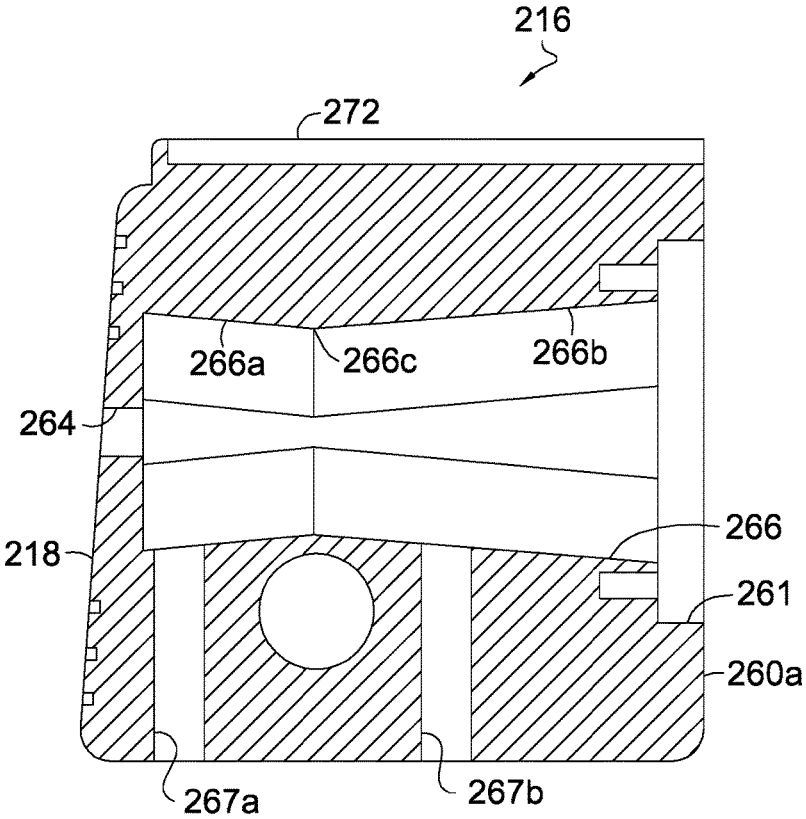
FIG. 22 is a side cross section view of the exemplary fitting head shown in FIG. 16 taken along line 22-22 shown in FIG. 21.
Figure 23:
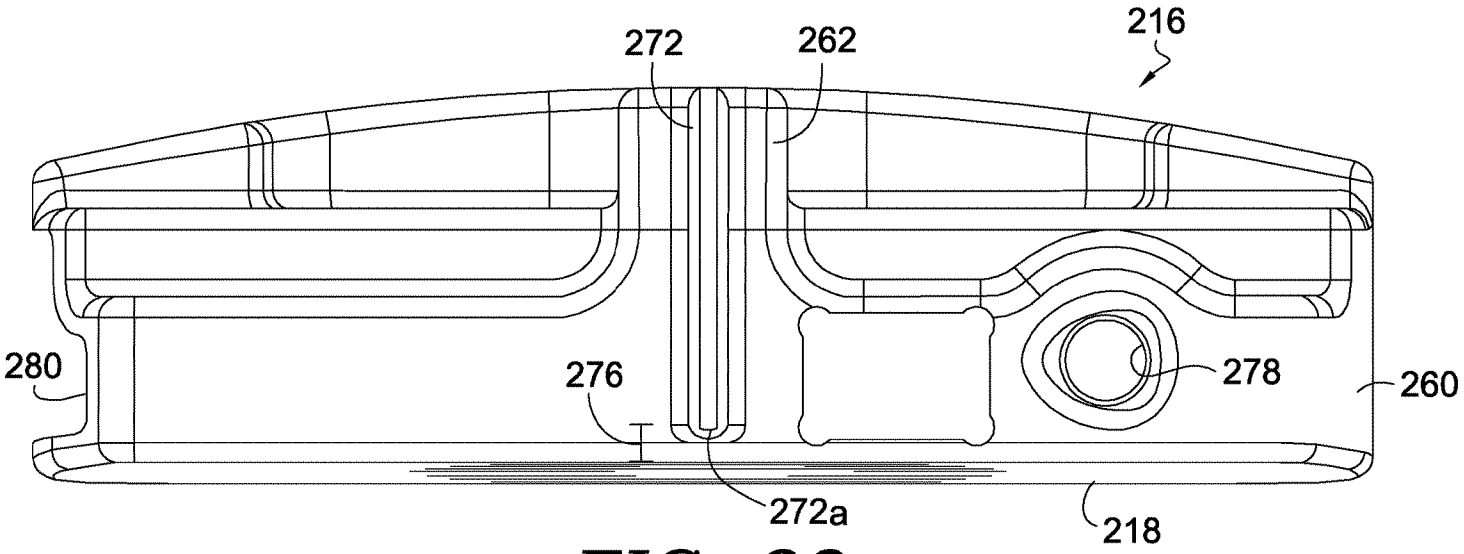
FIG. 23 is a top plan view of the exemplary fitting head shown in FIG. 16.

As shown in FIG. 22, tubular portion 262 may define open interior 266 having a first portion 266*a* and a second portion 266*b* each defining a respective tapered portion meeting at an annular constriction 266*c*. Annular constriction 266*c* may be dimensioned so as to snuggly receive the laser unit (or laser sleeve 268 if used) therethrough. Body portion 260 may then further define one or more lateral adjustment apertures 267*a*, 267*b* configured to threadably receive a respective set screw 269*a*, 269*b* therein, as will be discussed further below. Body portion 260 may also define a recess 261 dimensioned to receive a cover plate 263 therein such that, when fastenably mounted to body portion 260, cover plate 263 closes the rear opening 262*a* of tubular portion 262 so as to create a generally flush rear wall surface 260*a*.

As will be discussed in greater detail below, powering of the laser unit (e.g., analogous to laser unit 168 discussed above) causes a light beam (e.g., analogous to light beam 170 shown in FIGS. 14 and 15) to extend outwardly though aperture 264. In accordance with an aspect of the present invention, the laser unit may be a remote control activated laser unit such that the laser may be powered without requiring user contact with the unit. Set screws 269*a*, 269*b* may be selectively positioned within their respective aperture 267*a*, 267*b* so as to impinge upon the laser unit/laser sleeve 268. Set screws 269*a*, 269*b* may then be adjusted such that the light beam (e.g., light beam 170) projects through aperture 264 at a desired angle, e.g., in a generally horizontal trajectory (see FIG. 14).

Figure 16:
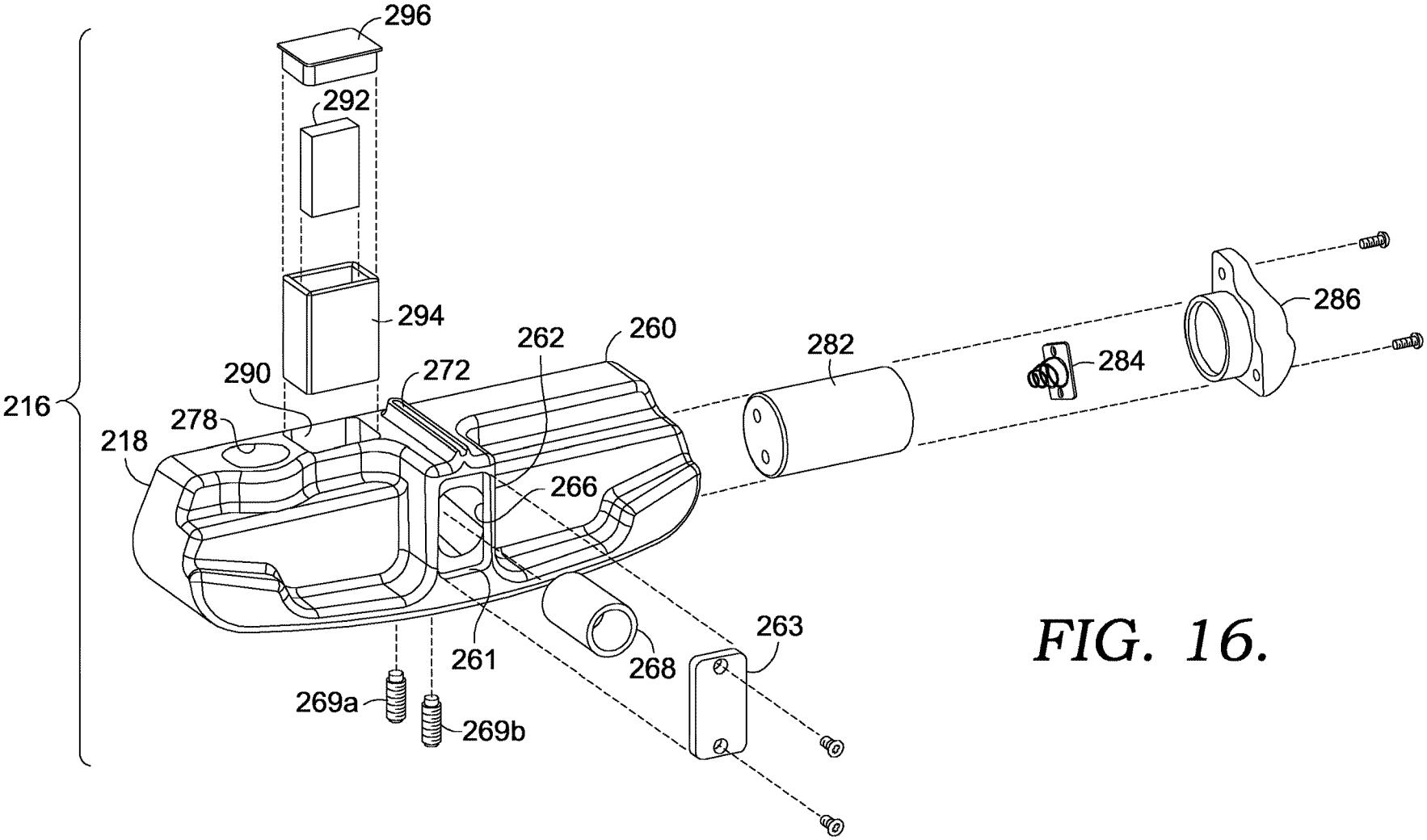
FIG. 16 is an exploded view of an alternative embodiment of an exemplary fitting head for use within a system for adjusting alignment of a golf club head in accordance with an aspect of the present invention.
Figure 24:
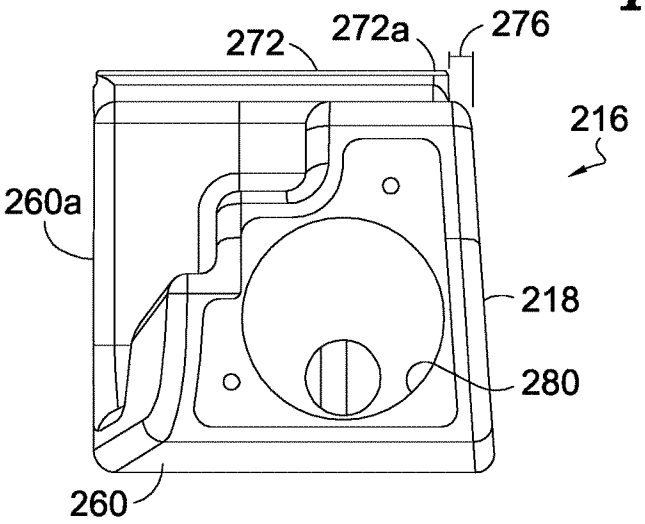
FIG. 24 is a left side view of the exemplary fitting head shown in FIG. 16 with the battery cover removed.
Figure 25:
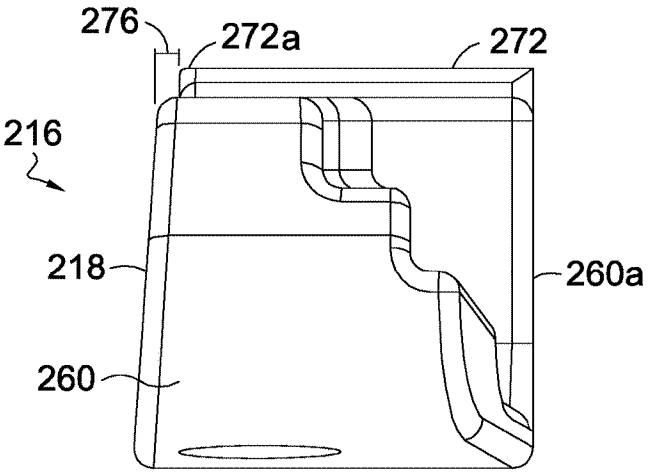
FIG. 25 is a right side plan view of the exemplary fitting head shown in FIG. 16.

As further shown in FIGS. 16 and 24, body portion 260 of fitting head 216 may further define a battery compartment 280 dimensioned to receive a battery 282 therein. In one aspect of the invention, battery compartment 280 may be arranged generally perpendicular to open interior 266 of tubular portion 262 so as to promote a compact blade style putter head. As shown in FIG. 16, a battery contact plate 284 and battery cover 286 secure battery 282 within body portion 260 whereby battery 282 is electrically coupled to the laser unit so as to power the laser during use. With continued reference to FIG. 16, body portion 260 may further include a relay aperture 290 dimensioned to receive a micro relay 292 therein. In one aspect of the invention, micro relay 292 is housed within a protective relay sleeve 294 and covered by a relay cap 296. Relay cap 296 is dimensioned to sit flush within relay aperture 290 and produce at smooth top wall 260*b* of body portion 260. Micro relay 292 is operably coupled to battery 282 and the laser unit whereby switching the micro relay 292 to an ON position powers the laser unit with battery power to emit laser light beam 170, and wherein switching micro relay 292 to the OFF position which disconnects power between battery 282 and the laser unit. Micro relay 292 may also be remotely actuated to selectively control switching between the ON and OFF positions.

Figure 19:
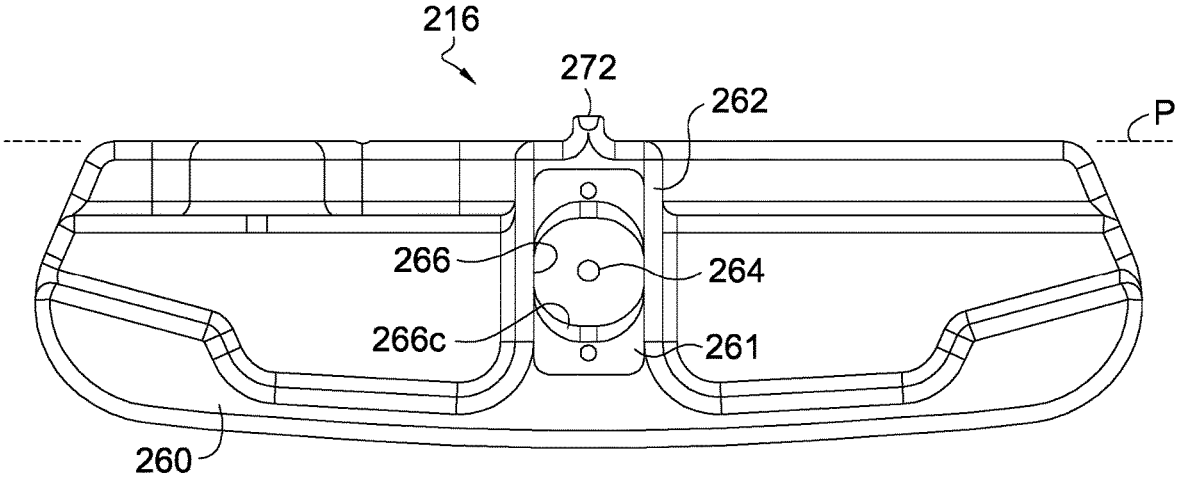
FIG. 19 is a rear plan view of the exemplary fitting head shown in FIG. 16.
Figure 20:
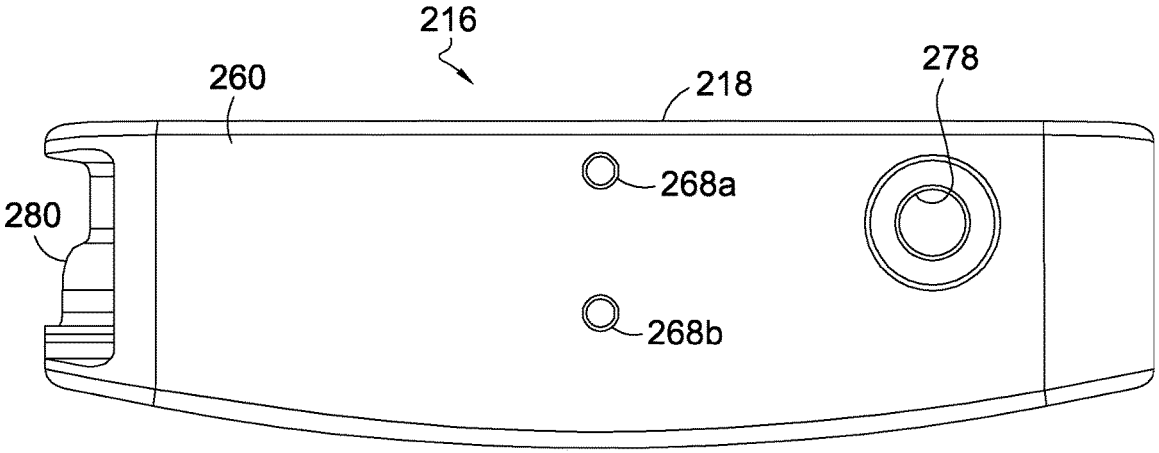
FIG. 20 is a bottom plan view of the exemplary fitting head shown in FIG. 16.
Figure 21:
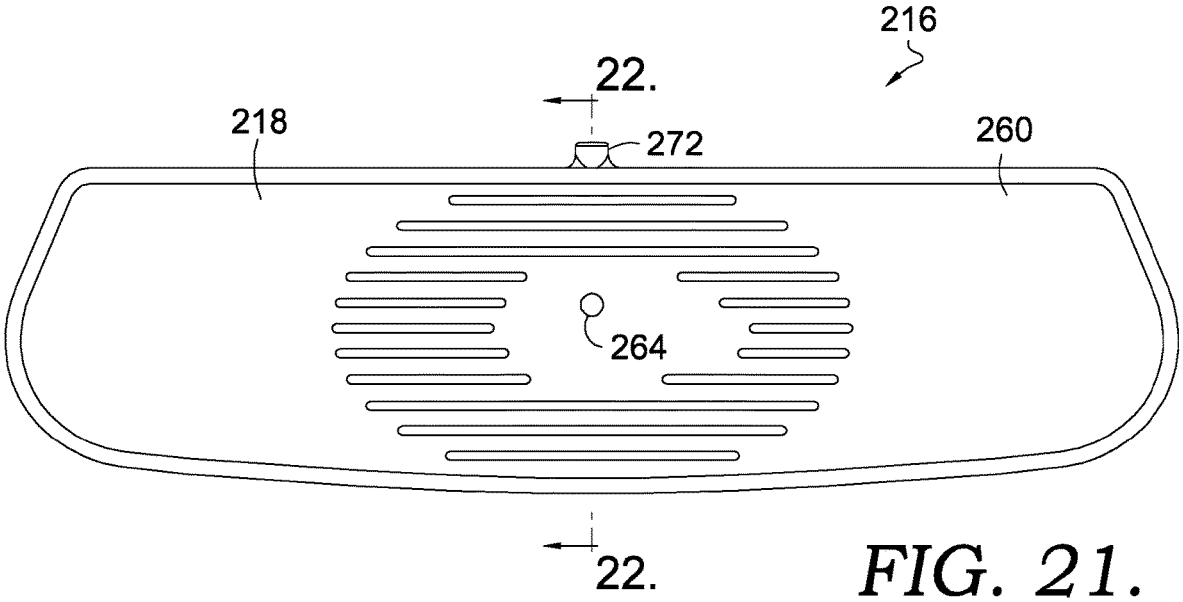
FIG. 21 is a front plan view of the exemplary fitting head shown in FIG. 16.

Fitting head 216 may further include a raised sight line 272 extending upwardly of the plane P formed by the top edge 274 of fitting head 216 (see FIG. 19). Raised sight line 272 is perpendicular to club face 218 and may be placed midway along club face 218. In accordance with an aspect of the invention, the forward edge 272*a* of raised sight line 272 is a spaced distance 276 from club face 218. Spaced distance 276 provides a visual break between raised sight line 272 and a golf ball which may assist the golfer is aligning the club head with the chosen target (for instance, a golf hole or cup). Raised sight line 272 may extend rearward any desired length, such as and without limitation thereto, the width of body portion 260; the width of body portion 260 and an intermediate length of tubular portion 262; or the entire width of body portion 260 and tubular portion 262.

In accordance with another aspect of the invention, the raised sight line 272 may be a color selected to contrast with the surface the club head 216. By way of example and without limitation thereto, club head 216 may comprise a black anodized aluminum construction. Raised sight line 272 may then be any color other than black, and in one aspect of the invention is selected to be orange. It has been found that the color orange provides sufficient contrast (as opposed to cooler colors such as blue, green or yellow) while also not being visually jarring, such as when using hot colors, such as red. Raised sight line 272 may be added to club head 216 by any suitable means, such as by painting or through affixing a filament element.

Figure 17:
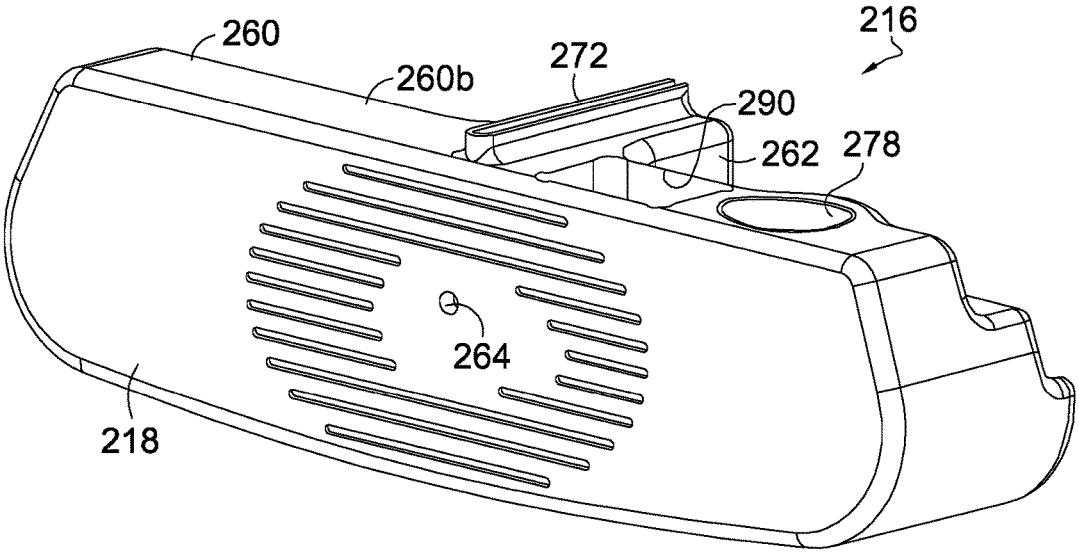
FIG. 17 is a front perspective view of the exemplary fitting head shown in FIG. 16.
Figure 18:
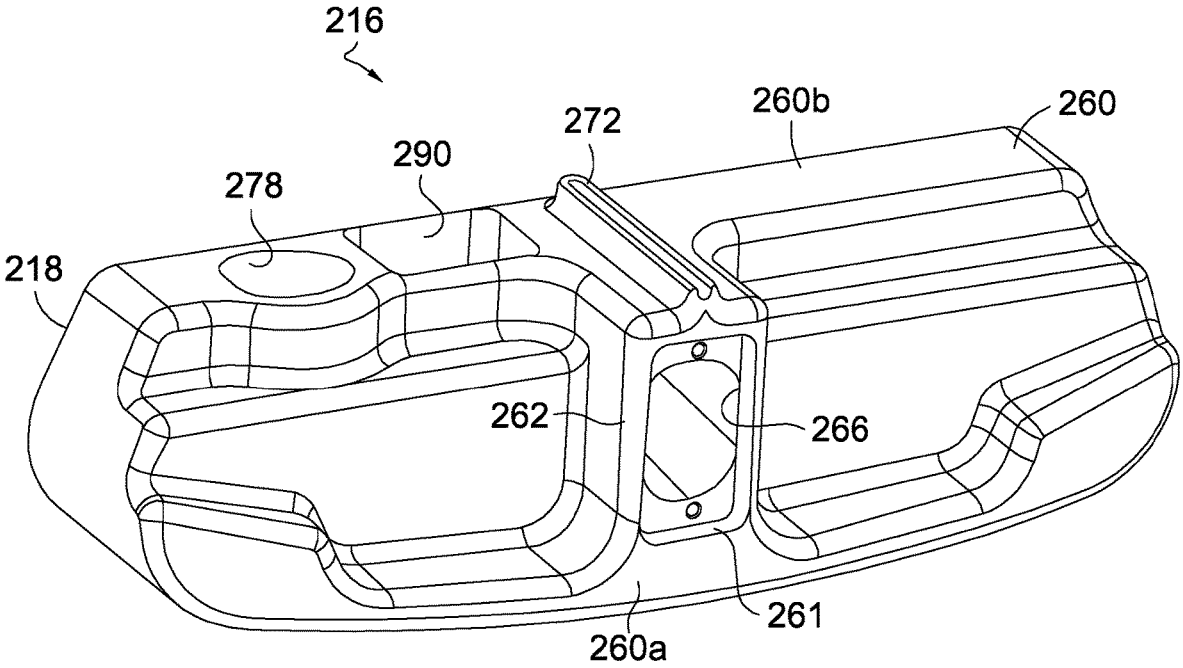
FIG. 18 is a rear perspective view of the exemplary fitting head shown in FIG. 16.

With reference to FIGS. 16-18, fitting head 216 may include a neck receiving orifice 278. Neck receiving orifice 278 is dimensioned to snuggly receive club end 142 of neck 114 such that fitting head 216, neck 114, hosel fitting 112 and club shaft 110 create a fully assembled golf club. It should be noted that fitting head 216 and receiving orifice 278, as shown in FIGS. 16-25, are configured to create a right-handed oriented golf club. It should be understood by those skilled in the art that an additional or alternative receiving orifice may be incorporated within fitting head 216 so as to enable creation of a left-handed oriented golf club. Thus, fitting head 216 may be adapted to suit either a left-handed or right-handed golfer.

Returning to FIG. 1, proximal end 110*b* of club shaft 110 may be equipped with a grip 180. In one aspect of the invention, grip 180 has a circular cross section, and may also have a tapered length such that an interior region 180*b* has a thickness greater than an outer region 180*a*. Without being tied to any one theory, it is believed that a thicker interior region promotes greater comfort to the golfer as the interior hand one the club during use tends to be the golfer's dominate hand. As such, the dominate hand has a stronger gripping force than the non-dominant hand, such that the increased thickness of interior region 180*b* provides increased biofeedback to the golfer leading to a sense of greater grip and control of the club.

In accordance with a further aspect of the present invention, particularly with regard to putter heads, it has been found that an optimal mass of the final club heads 116*bl*, 116*r*, 116*ml*, 116*mr*, 216 should be approximately 300 g, and still more particularly should be 287 g+/−0.5 g. It has been found that a putter head having a mass of 287*g* promotes proper release of the club once the club face strikes the golf ball, while also minimizing club weight which may lead to golfer fatigue. To promote proper "feel" to the club, the remaining components (i.e., grip, shaft, hosel and neck) should weigh as little as possible. As a result, the center of gravity of the club will rest in the body of putter head and promote a satisfactory pendulum motion during a putting stroke.

Figure 14:
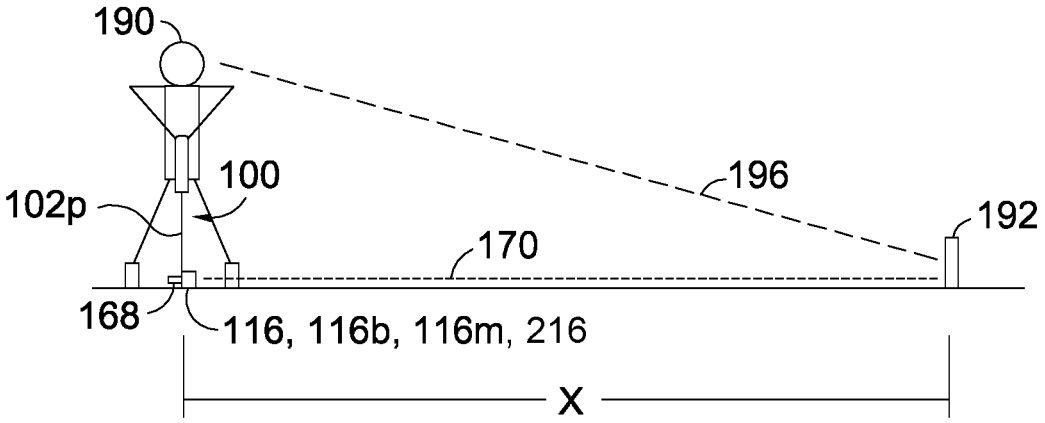
FIG. 14 is a schematic representation of a golfer aligning a club head to target.
Figure 15:
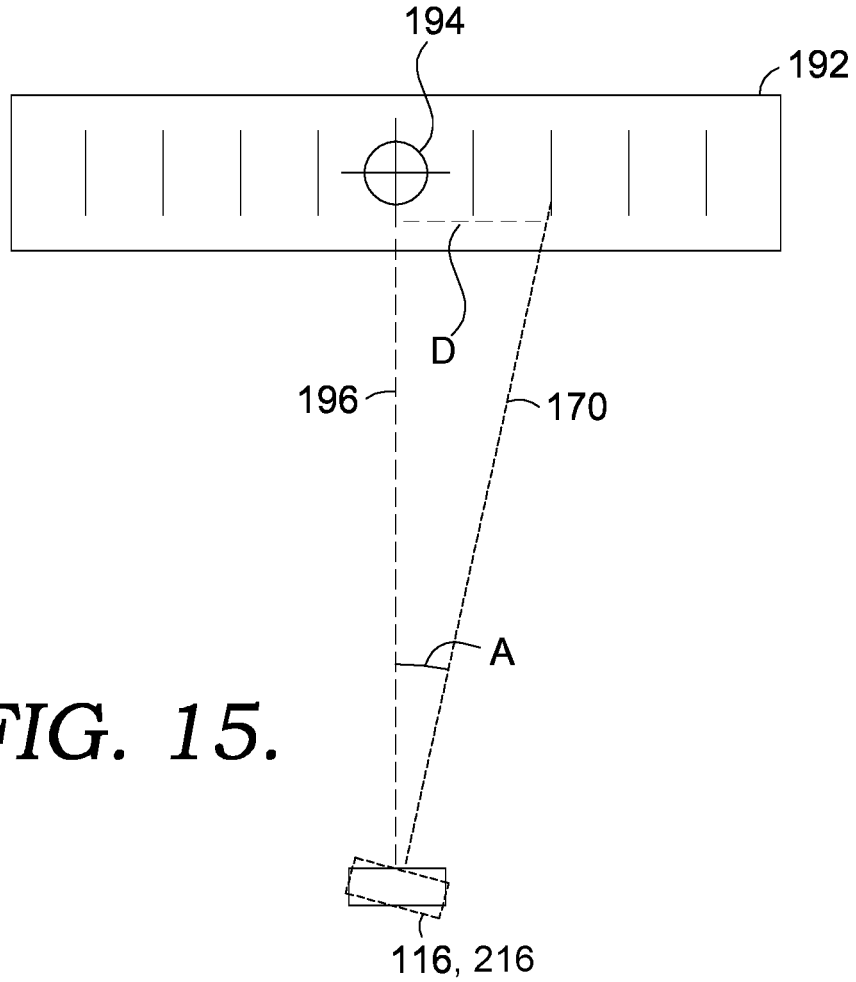
FIG. 15 is a schematic representation of a stationary target showing perceived club head alignment and actual club head alignment.

Turning now to FIGS. 14 and 15, and in accordance with a further aspect of the present invention, system 100 may be employed by a golfer 190 to adjust the alignment of the golfer's clubs, such as putter 100*p*. Initially, golfer 190 is provided a golf club (putter 102*p*) equipped with a fitting head (i.e., fitting head 116*b*, 116*m*, 216) having a laser unit (e.g., laser unit 168) mounted therein as described above. Golfer 190 is then positioned a predetermined distance X away from a stationary target 192. While any distance may be selected, in accordance with an aspect of the present invention, distance X is selected to be 12 feet.

With golfer 190 so positioned, golfer 190 is asked to align putter 102*p* with the center "hole" 194 on stationary target 192. Stationary target hole 194 is representative of a golf hole or cup on a putting green. Once golfer 190 has indicated that putter 102*p* is aligned with hole 194, laser unit 168 is powered on such that a light beam 170 is emitted from fitting head 116, 216 toward stationary target 192 where it strikes stationary target 192. With the light beam 170 shining on stationary target 192, a fitting technician can determine the amount of deviation D (angle A) between the golfer's perceived alignment 196 and actual alignment (i.e., light beam 170).

The fitting technician may then rotate the neck 114 relative to hosel fitting 112 a counter angle such that deviation D is negated (such as indicated by reference line 148 with relation to index lines 132). Neck 114 may then be secured coupled to hosel fitting 112 to prevent any further rotation. Once neck 114 has been secured, the fitting head 116, 216 may be removed and a selected final club head 116*bl*, 116*r*, 116*ml*, 116*mr* may then be mounted onto neck 114 as described above. In this manner, while a golfer believes the club face is properly visually aligned with the target, the rotated nature of the club face compensates for the golfer's visual inaccuracy such that properly striking the ball with cause the ball to travel on target despite the golfer's visual misalignment.

It should be further noted that, by raising sight line 172, 272 above the surface of their respective putter head 116, 216, the golfer does not visually discern the non-perpendicular angle of the adjusted club face relative to the target. That is, the club head continues to be perceived as non-adjusted. However, it has been found that should the sight line be along the surface of the putter head, or scribed within the putter head, the golfer will note the physical misalignment of the putter head and will attempt to compensate for it, thus leading to more missed shots, as well as user discomfort.

The foregoing description of the preferred embodiment of the invention has been presented for the purpose of illustration and description. It is not intended to be exhaustive nor is it intended to limit the invention to the precise form disclosed. It will be apparent to those skilled in the art that the disclosed embodiments may be modified in light of the above teachings. The embodiments described are chosen to provide an illustration of principles of the invention and its practical application to enable thereby one of ordinary skill in the art to utilize the invention in various embodiments and with various modifications as are suited to the particular use contemplated. Therefore, the foregoing description is to be considered exemplary, rather than limiting, and the true scope of the invention is that described in the following claims.

What is claimed is:

1. A system for adjusting alignment of a golf club head, the system comprising:

a) a club shaft having a proximal end and an opposing distal end;

b) a hosel fitting fixedly secured to said distal end of said club shaft;

c) a neck having a first end and a second end, wherein said first end is rotationally coupled to said hosel fitting; and d) a club head coupled to said second end of said neck, wherein said club head comprises a fitting head having a body portion defining a club face and a tubular portion extending perpendicularly rearward from said club face, wherein said club face includes an aperture in communication with an open interior of said tubular portion, and wherein said open interior is dimensioned to receive a laser unit therein, wherein powering of said laser unit causes a light beam to extend outwardly of said club face through said aperture.

2. The system in accordance with claim 1, wherein rotation of the neck about said hosel fitting adjusts an angle of said club face relative to a vertical axis defined by said club shaft.

3. The system in accordance with claim 2, wherein said hosel fitting includes one of a reference line or a series of angle index lines, and wherein said neck includes the other of said reference line or said series of angle index lines, whereby said angle is selectively adjusted by selectively aligning a single angle index line with said reference line.

4. The system in accordance with claim 3, wherein each successive angle index line within said series of angle index lines corresponds to 1 degree of rotation of said club face.

5. The system in accordance with claim 3, wherein said neck is secured to said hosel fitting through an interference fit to thereby prevent further rotation of said neck.

6. The system in accordance with claim 1, wherein said club head includes a raised sight line extending upwardly of a plane formed by a top edge of said club face, wherein said raised sight line is perpendicular to said club face.

7. The system in accordance with claim 6, wherein a forward end of said raised sight line terminates a spaced distance from said club face.

8. The system in accordance with claim 6, wherein said raised sight line extends perpendicularly from the midpoint of said top edge of said club face.

9. The system in accordance with claim 1, wherein said proximal end of said club shaft includes a grip having a circular cross section.

10. The system in accordance with claim 9, wherein said grip has a tapered length wherein a first portion of said grip proximate said proximal end of said club shaft has a smaller diameter than a second portion of said grip distal said proximal end of said club shaft.

11. The system in accordance with claim 1, wherein said body portion includes a pair of neck receiving apertures, wherein a first aperture of the pair of apertures is configured to receive said neck portion to create a right-handed golf club and wherein a second aperture of the pair of apertures is configured to receive said neck portion to create a left-handed golf club.

12. The system in accordance with claim 1, wherein one or both of said body portion and said tubular portion include a threaded aperture portion to threadably couple said laser unit to said fitting head.

13. The system in accordance with claim 1, wherein said powering of said laser is via remote control.

14. A method for adjusting the alignment of a golf club head, the method comprising:

a) providing a golf club having a fitting head mounted thereon, the fitting head comprising:

i) a club shaft having a proximal end and an opposing distal end;

ii) a hosel fitting fixedly secured to said distal end of said club shaft;

iii) a neck having a first end and a second end, wherein said first end is rotationally coupled to said hosel fitting; and iv) a club head coupled to said second end of said neck, wherein said club head has body portion defining a club face and a tubular portion extending perpendicularly rearward from said club face, wherein said club face includes an aperture in communication with an open interior of said tubular portion, and wherein said open interior is dimensioned to receive a laser unit therein, wherein powering of said laser unit causes a light beam to extend outwardly of said club face through said aperture, b) positioning a golfer a predetermined distance away from a stationary target;

c) allowing the golfer to align the golf club to the stationary target;

d) powering the laser to emit a laser beam from the golf club toward the stationary target to establish a golfer alignment value;

e) determining an amount of deviation of the golfer alignment value from the stationary target;

f) rotating said neck on said hosel fitting to negate the amount of deviation whereby said laser beam coincides with said stationary target; and g) securing said neck to said hosel fitting to prevent further rotation of said neck.

15. The method in accordance with claim 14, further comprising the steps of:

a) removing said fitting head from said neck after securing said neck to said hosel filling (step g); and b) securing a desired club head to said neck.

16. A golf club head comprising:

a) a body portion defining a club face;

b) a tubular portion defining an open interior extending perpendicularly rearward from said club face, wherein said open interior is dimensioned to receive a laser unit therein;

c) an aperture defined within said club face and in communication with said open interior of said tubular portion;

d) a battery compartment defined within said body portion and extending perpendicularly to said tubular portion, wherein the battery compartment is configured to receive a battery therein, wherein the battery is configured to be electrically connected to the laser wherein powering of the laser unit via the battery causes a light beam to extend outwardly of said club face through said aperture.

17. The golf club head in accordance with claim 16, wherein the body portion further defines at least one lateral adjustment aperture adapted to threadably receive a corresponding set screw therein, wherein alignment of the laser unit is adjustable via said set screw.

* * * * *